US007645047B2

(12) United States Patent
Martinez

(10) Patent No.: US 7,645,047 B2
(45) Date of Patent: Jan. 12, 2010

(54) DEPLOYABLE EMERGENCY LIGHTING SYSTEM

(75) Inventor: Patrick Martinez, Thousand Oaks, CA (US)

(73) Assignee: Emerge Products, LLC, Sherman Oaks, CA (US)

( * ) Notice: Subject to any disclaimer, the term of this patent is extended or adjusted under 35 U.S.C. 154(b) by 144 days.

(21) Appl. No.: 11/725,793

(22) Filed: Mar. 20, 2007

(65) Prior Publication Data

US 2008/0232081 A1 Sep. 25, 2008

(51) Int. Cl.
*F21V 19/04* (2006.01)

(52) U.S. Cl. ..... 362/20; 362/147; 362/183

(58) Field of Classification Search ..... 362/183, 362/184, 228, 230, 234, 286, 270, 272, 285, 362/20, 147
See application file for complete search history.

(56) References Cited

U.S. PATENT DOCUMENTS

| | | | | |
|---|---|---|---|---|
| 3,217,156 | A | 9/1965 | Sherwood | |
| 3,976,986 | A | 8/1976 | Zabroski | |
| 4,304,070 | A * | 12/1981 | Musacchia | 49/2 |
| 4,410,835 | A | 10/1983 | Zabroski | |
| 4,617,561 | A | 10/1986 | Brown | |
| 4,631,649 | A | 12/1986 | McCue et al. | |
| 4,708,223 | A | 11/1987 | Orndorff et al. | |
| 4,802,065 | A | 1/1989 | Minter et al. | |
| 4,862,147 | A * | 8/1989 | Thomas | 340/628 |
| 5,025,349 | A | 6/1991 | Gow | |
| 5,365,145 | A | 11/1994 | Fields | |
| 5,548,494 | A * | 8/1996 | Blackman | 362/183 |
| 5,682,131 | A * | 10/1997 | Gow | 340/286.11 |
| 6,336,729 | B1 * | 1/2002 | Pavelle et al. | 362/34 |
| 6,371,621 | B1 * | 4/2002 | Le Bel | 362/20 |
| 6,527,419 | B1 | 3/2003 | Galli | |
| 6,605,900 | B2 | 8/2003 | Chien | |
| 6,874,907 | B2 | 4/2005 | Liao | |
| 6,933,678 | B2 | 8/2005 | Kuo | |
| 7,026,768 | B1 | 4/2006 | Ruiz | |
| 7,045,975 | B2 | 5/2006 | Evans | |
| 7,118,235 | B2 | 10/2006 | Barton | |
| 7,220,010 | B2 | 5/2007 | Corbett et al. | |
| 2005/0157482 | A1 | 7/2005 | Hsu | |
| 2006/0239003 | A1 | 10/2006 | Eisenson | |

* cited by examiner

*Primary Examiner*—Sandra L O'Shea
*Assistant Examiner*—Danielle Allen
(74) *Attorney, Agent, or Firm*—Cislo & Thomas, LLP

(57) ABSTRACT

An emergency lighting system comprising a housing further comprising a flat cover, wherein the flat cover automatically opens during an emergency condition; a light source located inside the housing further comprising a rechargeable battery and a wide angle LED light bulb, wherein the light source remains off under a normal condition and the light source automatically turns on in response to an emergency condition, and wherein the light source is removable.

17 Claims, 8 Drawing Sheets

DEPLOYABLE EMERGENCY LIGHTING SYSTEM

BACKGROUND OF THE INVENTION

1. Technical Field

This invention relates to emergency lights that are deployed during an emergency situation, such as a power failure.

2. Background Art

During a power failure, particularly at night, it is necessary to have some form of battery operated light that is easy to find and easy to access. Most residential home owners rely on flashlights conveniently placed so they would know where to find the flashlight in the dark. However, these common flashlights do not automatically turn on and can be misplaced. In addition, whether the batteries work or not, may not be known until its use, which may be during the emergency. Most commercial buildings use surface mounted safety lights. These may provide guidance in which direction to go, but these lights cannot be used like a flashlight by the occupant. "Plug-In" style safety lights have also been used in residential applications. However, these "Plug-In" styles may not be aesthetically pleasing. In addition, "Plug-In" style lights require the use of an outlet, thereby, reducing the number of outlets available for other uses. Also, a light switch that "glows" in the dark has been recently patented. However, this device cannot be used like a flashlight. Therefore, there is a need for an emergency lighting system that automatically deploys during an emergency situation, such as a power failure, that provides guidance in which direction to go and that is removable so as to be taken by the occupant to use as a flashlight. Furthermore, the device needs to be rechargeable when power is available so that battery power is always available during the emergency.

BRIEF SUMMARY OF INVENTION

The present invention is directed to an emergency lighting system designed to automatically deploy during an emergency condition, such as a power outage. The device is a module that could be installed in a standard single gang device enclosure. In the "off" position it is a fiat blank cover that could blend in with the wall and not be noticed. When it is in this position it would also be using 110V AC power to charge the batteries located inside the light. When the power to the building is lost, the front cover acts as a trap door to allow the light to angle out from the wall. The light would then turn on and illuminate the area above it. It would act as an emergency light to allow people to easily find their way out of the building or home. The light portion will also be removable so that someone can pull it out of the module and use it as a flashlight.

DETAILED DESCRIPTION OF THE INVENTION

Figure 1:
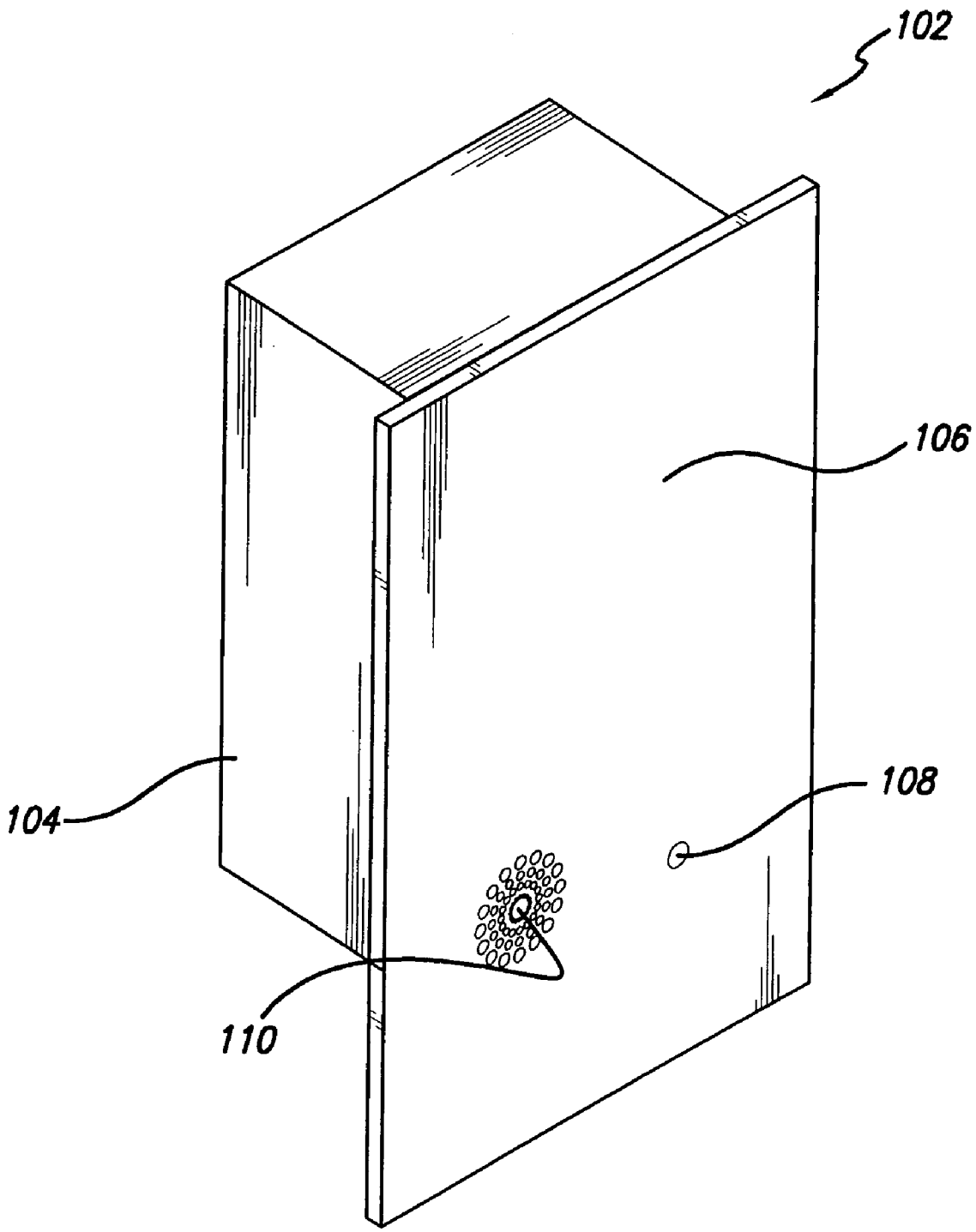
FIG. 1 is a perspective view of an embodiment of the current invention.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The present invention is an emergency lighting system 102 comprising a housing 104, a cover 106 attached to the housing 104, and a light source 202, located inside the housing 104 during normal conditions, further comprising at least one power source 700, wherein the light source 202 remains off under normal conditions and the light source 202 automatically turns on in an emergency situation and can be removed from the housing 104. For example, under the normal condition, such as when there is power to a building or a home, the light source 202 remains off and the power source 700, such as a rechargeable battery, would charge. Under an emergency condition, such as when there is power failure, the cover 106 would open like a trap door and the light source 202 would turn on and angle out from the wall, thereby providing lighting to an area or pathway for a safe exit. This would allow the occupant of the premises to see the light, walk towards the light and remove the light source 202 from the housing 104 and use it as a flashlight.

Figure 2A:
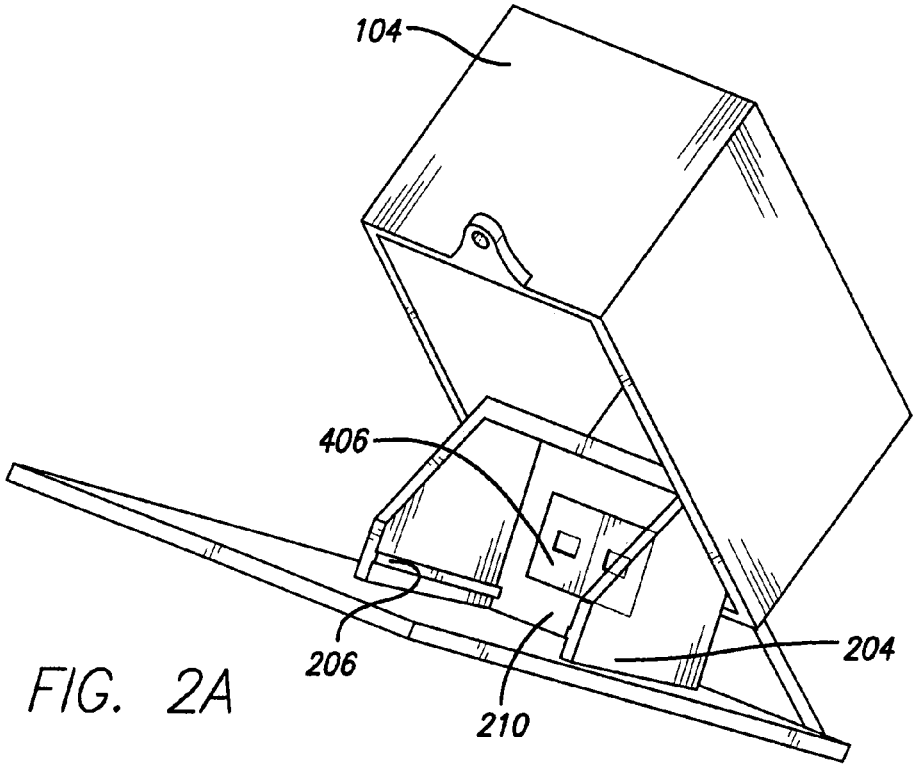
FIG. 2A is a perspective view of an embodiment of the current invention in a deployed position.
Figure 2B:
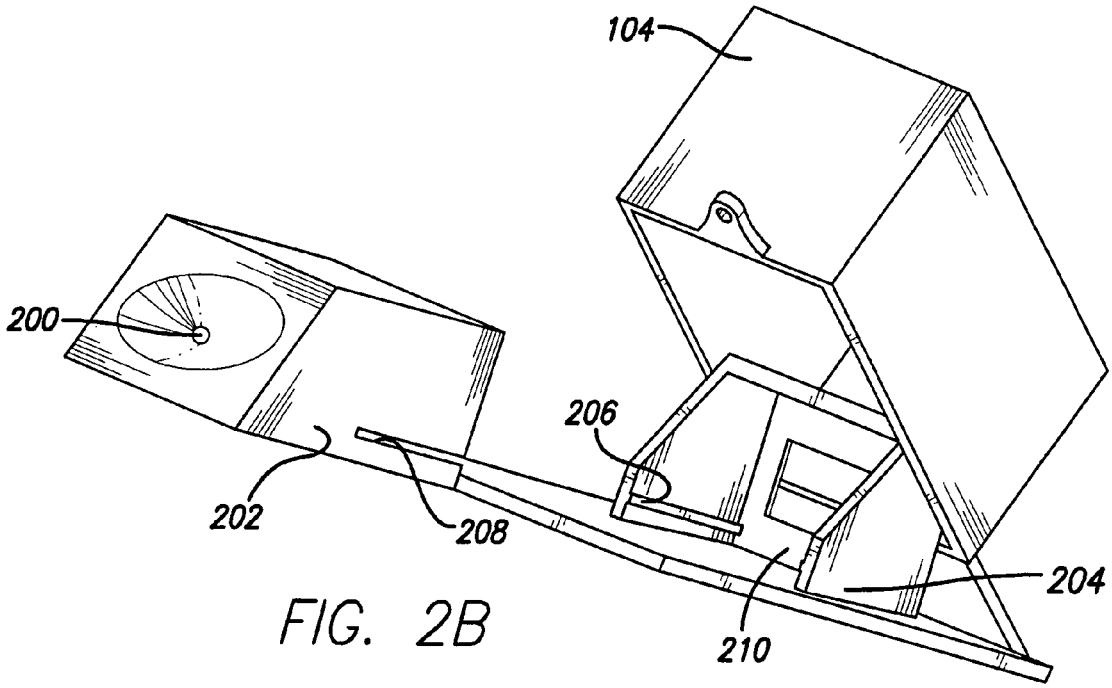
FIG. 2B is perspective view of another embodiment of the current invention in a deployed position.
Figure 3:
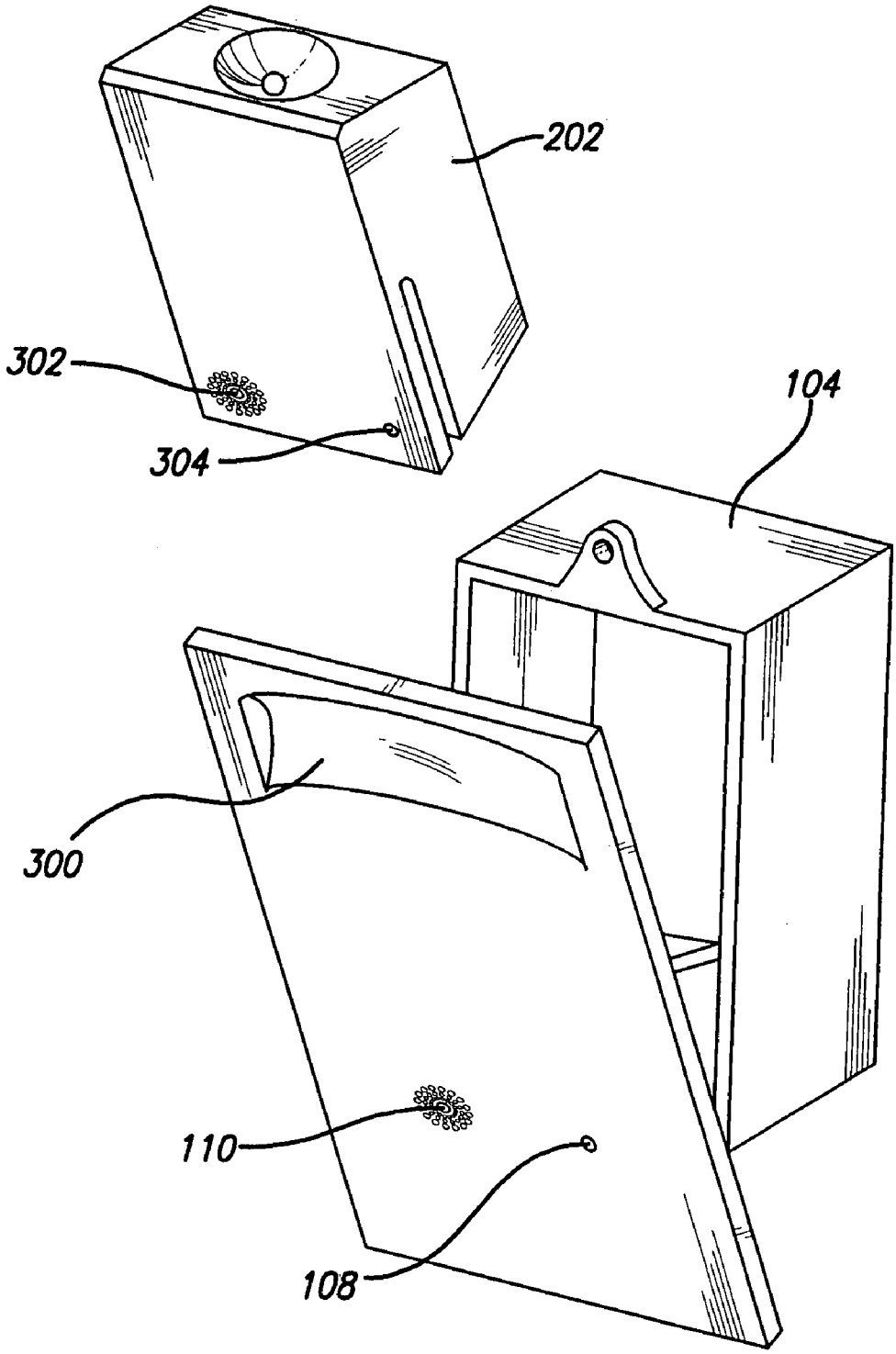
FIG. 3 is another view of an embodiment of the current invention.

As shown in FIG. 1, the device is a module that would be installed in a standard single gang device enclosure. Generally the housing 104 would be a small container about the size of a standard outlet or light switch, suitable for holding a small light source 202, such as a flashlight. A cover 106 can be attached to the housing 104 that would hide the contents inside the housing 104. The cover 106 can be flat and blend in with the wall, thereby being inconspicuous. As such, the cover 106 can be painted or covered by wall paper, with appropriate slits along the edges to allow the cover 106 to open. This would hide the light source 202 so that it cannot be seen under normal conditions. However, the cover 106 can be any shape that is aesthetically pleasing or artistic in nature. It is preferable that the housing 104 be mounted in the wall; however, the housing 104 can be mounted on the ceiling, in the floor, or any other location that can be seen in plain view. As shown in FIGS. 2 and 3, the cover 106 of the housing 104 can further function as a door, such that the cover 106 can be opened during or in response to an emergency condition, such as a power failure, and the light source 202 can be removed.

An occupant should be able to open or detach the cover 106 from the housing 104 quickly and easily. For example, as shown in FIGS. 4-6, the cover 106 can be attached to the housing 104 by a latch system, a magnet, a resistance, a swiveling lock, a door knob-type mechanism, or any other mechanism that allows the cover to be opened immediately and without the assistance of other tools. There are a number of ways for opening covers. For example, the cover 106 can swing open to the left, to the right, up or down on a hinge. Alternatively, the cover 106 can slide to the left, to the right, up or down, or even straight out perpendicular to the wall. The cover 106 can also use gear mechanisms alone or in combination with the aforementioned mechanisms.

As shown in FIG. 4, in a preferred embodiment, the cover 106 is connected to the housing 104 by a hinge 400. Preferably the hinge 400 is at a bottom, outer edge of the housing 104 with the light source 202 sitting upright in the housing 104, such that during an emergency condition, such as a power failure, the cover 106 can open by swinging outward and downward on the hinge 400. As shown in FIGS. 2A and 2B, the cover 106 can further comprise a support 204 where the light source 202 can be mounted. The support 204 can further comprise a tongue 206 and the light source 202 can further comprise a groove 208, such that the groove 208 fits into the tongue 206 to secure the light source 202 in the support 204. This allows the light source to be quickly and easily removed during an emergency situation and replaced when normal conditions are returned. The support 204 can further comprise a floor 210, wherein the floor further comprises a battery recharging base 406. In another embodiment, the floor 210 comprises a hole and the battery recharging base 406 is located on the housing 104 such that in the closed position the battery terminals 800 can make contact with the battery recharging base 406 through the hole of the floor 210 as shown in FIG. 5B.

Under normal conditions, the light source 202 is hidden in the housing 104. Preferably, the light source 202 is mounted onto the cover 106. When the emergency lighting system deploys the cover 106 detaches from the housing 104 and tilts out such that when the light source 202 is turned on in response to the emergency condition or due to the opening of the cover 106, the light will shine out from the wall at an angle. This would be plainly visible to anybody in the vicinity. The light source is not connected or attached to the housing or the cover by electrical wires so that in the deployed configuration the light source 202 can be removed and carried away completely free from the housing 104 as shown in FIG. 2B.

In another embodiment the light source 202 can sit in the housing 104 on its side facing outward perpendicular to the wall. During an emergency condition, the cover 106 of the housing 104 can simply swing, flip, or slide open such that when the light source 202 is turned on the light can be seen shining perpendicularly outward from the wall. The light source 202 can also rest on a support 204 movably coupled to the housing 104 such that the support 204 can be automatically ejected out of the housing 104 when the cover 106 is opened. The support 204 can slide out, roll out, fall out, be pushed out, be pulled out or be ejected in a number of different ways.

Similar mechanisms can be employed for detaching or opening the cover 106 of the housing 104 regardless of whether the housing 104 is mounted on the wall, the floor, the ceiling, or any other convenient location. However, if the housing 104 is mounted on the ceiling, the light source 202 would have to be attached to the housing 104 by a string, a rope, a strap, a chain, or the like so as to dangle far enough towards the ground for an occupant to reach the light source 202. This will prevent the light source 202 from falling to the ground while still providing light that can be seen in plain view.

Figure 4A:
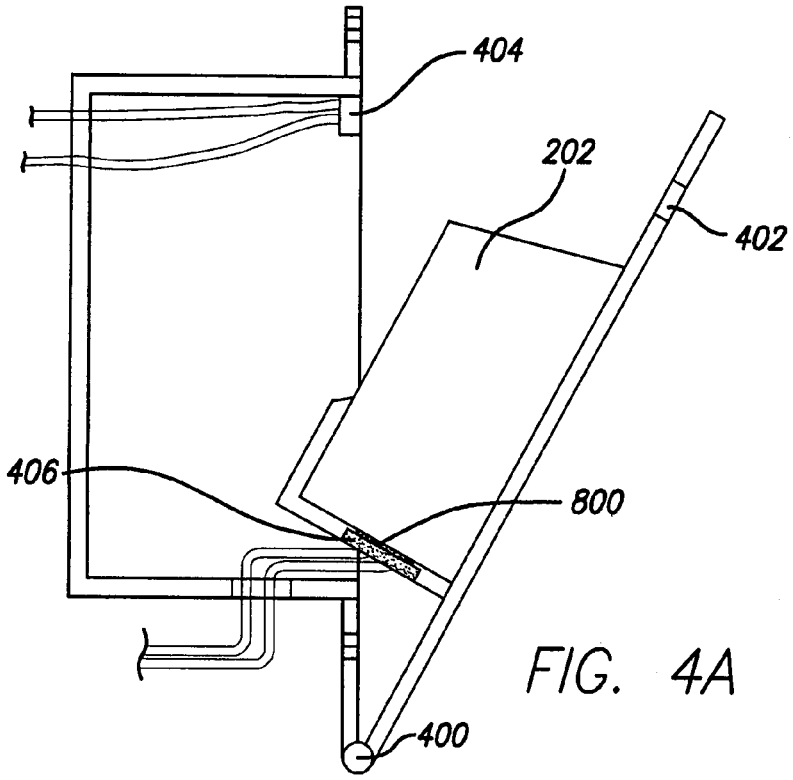
FIG. 4A is a side view of an embodiment of the current invention in the deployed position.
Figure 4B:
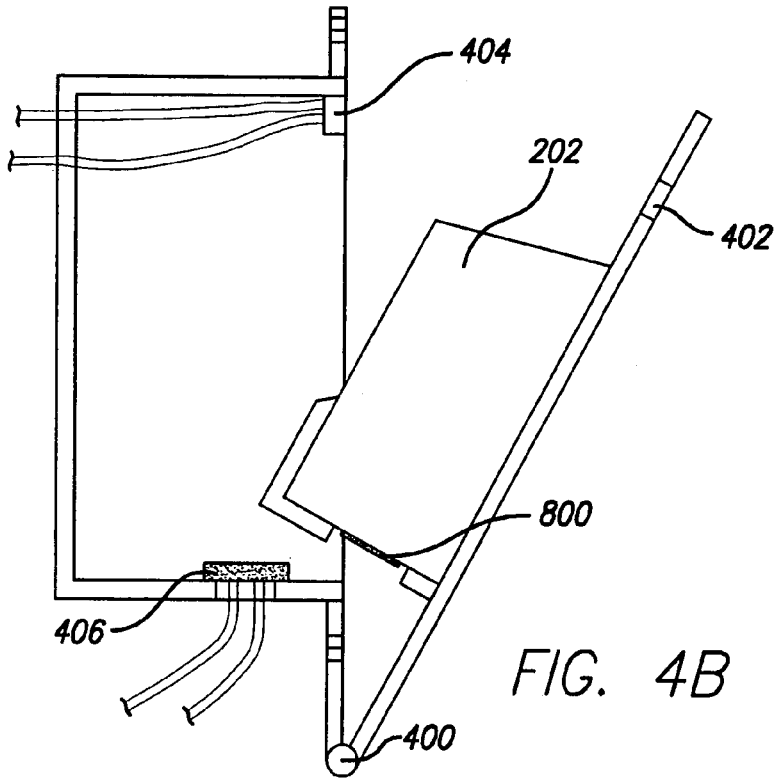
FIG. 4B is a side view of another embodiment of the current invention in the deployed position.

In another embodiment, as shown in FIGS. 4A and 4B, the emergency lighting system 102 can be wired such that the cover 106 opens automatically or detaches automatically from the housing 104 during a power failure to provide a means for accessing the light source 202. The cover 106 opening or detaching automatically during an emergency situation, such as a power failure, provides a means for transmitting light to allow an occupant to see in which direction to go. There are numerous mechanisms for allowing a cover to open automatically during a power failure. For example, the cover 106 can comprise a hinge 400 at the bottom that naturally would keep the cover 106 in the open position by a spring. Alternatively, the cover 106 can have gears, hinges, slides, or any other mechanism that provides a mechanism for opening the cover 106. The cover 106 can have a metal strip 402 with magnetic properties and the housing 104 can have a magnet 404. Alternatively, the metal strip 402 can be on the housing 104 and the magnet 404 on the cover 106. In another embodiment, the cover 106 and the housing 104 can both have magnets 404 of opposite polarity. The magnet 404 can be an electromagnet powered by the mains power from a standard outlet next to the housing 104. During a power failure, the electric current to the electromagnet 404 would be terminated, turning the electromagnet 404 off. This would release the connection between the cover 106 and the housing 104 and cause the spring hinge 400 to force the cover 106 open.

In another embodiment, as shown in FIG. 6, the cover 106 can be opened manually or detached manually from the housing 104. For example, the magnet 404 can be a standard magnet. This allows an occupant to quickly and easily detach the cover 106 from the housing 104 so as to provide access to the light source 202 during an emergency condition. The occupant can then reach inside and pull out the light source 202 and use it like a flashlight. Other mechanisms to allow the cover 106 to be quickly and easily detached from the housing 104 or opened include, but are not limited to, latch systems, resistance mechanisms, swivel locks, and door knob-type mechanisms.

The cover 106 can further comprise a means for transmitting light without opening the cover 106. For example, the cover 106 can further comprise a first transparent portion 300. The first transparent portion 300 can be a hole, a window, a clear piece of plastic or any other material that allows for the transmission of light. The first transparent portion 300 can also be a variety of different colors. Alternatively, the entire cover 106 or any portion of the cover can be translucent. In embodiments where the cover 106 further comprises a means for transmitting light without opening the cover 106, the cover 106 can be opened manually rather than automatically. Since the light can be transmitted through the cover, the light can still be visible in plain view. The occupant can then walk towards the light and manually open the cover 106 to access the light source. To facilitate manually opening the cover 106, the cover 106 can further comprise a handle 600. In one embodiment the first transparent portion 300 can be concave so as to create a handle 600.

In another embodiment the housing 102 further comprises a means for ejecting the light source 202 out of the housing 102 such that the light source 202 can be easily grasped. This is particularly important for those with large hands who might not be able to reach into the housing 102 and pull out the light source 202. The support 204 can be coupled to the cover 106 by slides, gears, hinges or the like. The opening of the cover 106 could automatically force the support 204 up or out such that the light source 202 protrudes out from the housing 104.

This allows the occupant to grasp a portion of the light source 202 without having to stick his/her hands into the housing 104.

In another embodiment, the light source 202 can comprise a protrusion or a strap or any other device located near an opening of the housing such that the protrusion or strap can be grasped by the occupant without having to reach his/her entire hand into the housing.

The light source 202 further comprises a light element 200 such as an incandescent light bulb, light emitting diode ("LED"), LED array, gas discharge lamp (e.g. neon), fluorescent bulb, phosphorous light or any other device that emits light. In a preferred embodiment the light element 200 is a high intensity, wide angle, light emitting diode. LEDs produce high output with very little battery draw and nearly endless life cycle. Also LEDs can be easily focused and dispersed with an adjustable lens. The light source 202 can also be removable from the housing 104 so as to be used as a flashlight.

In addition, the light source 202 can also have an audible alarm 302 as a secondary mechanism to alert an occupant as to the location of the emergency lighting system 102. The audible alarm 302 can be wired so as to turn on during a power failure and powered by the power source 700. In addition, the audible alarm 302 can function to indicate when the charge of the power source 700 is low so that a user can replace the power source 700 when necessary. The light source 202 can also have a battery light indicator 304 to indicate when the charge in the power source 700 is low.

Figure 5A:
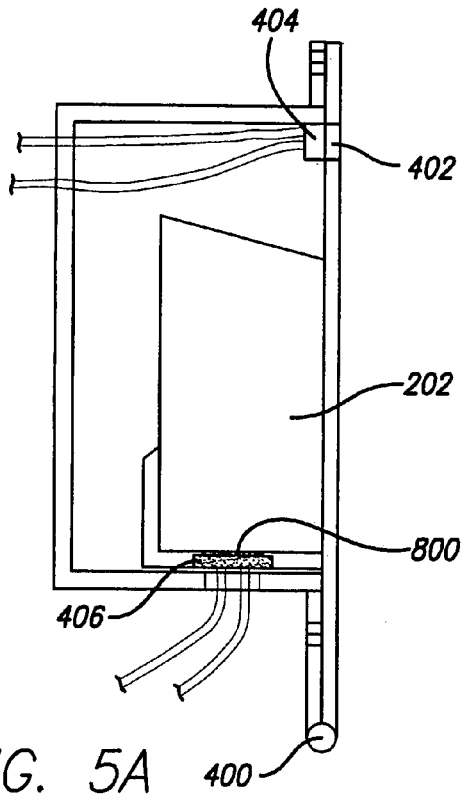
FIG. 5A is a side view of an embodiment of the current invention in the closed position.
Figure 5B:
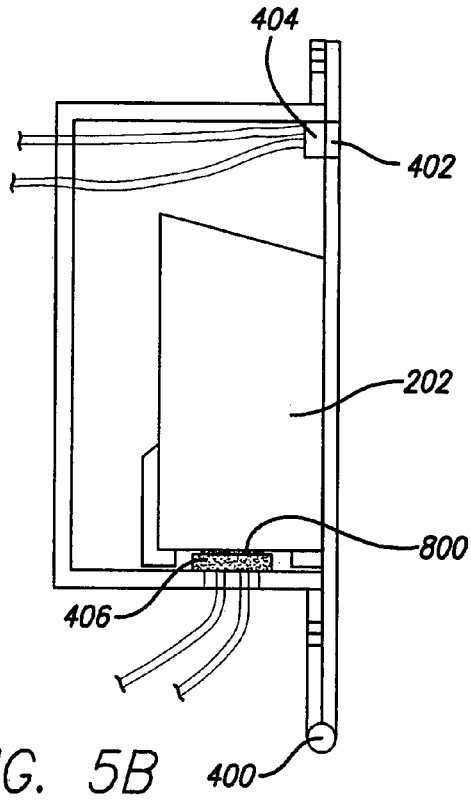
FIG. 5B is a side view of another embodiment of the current invention in the closed position.
Figure 6:
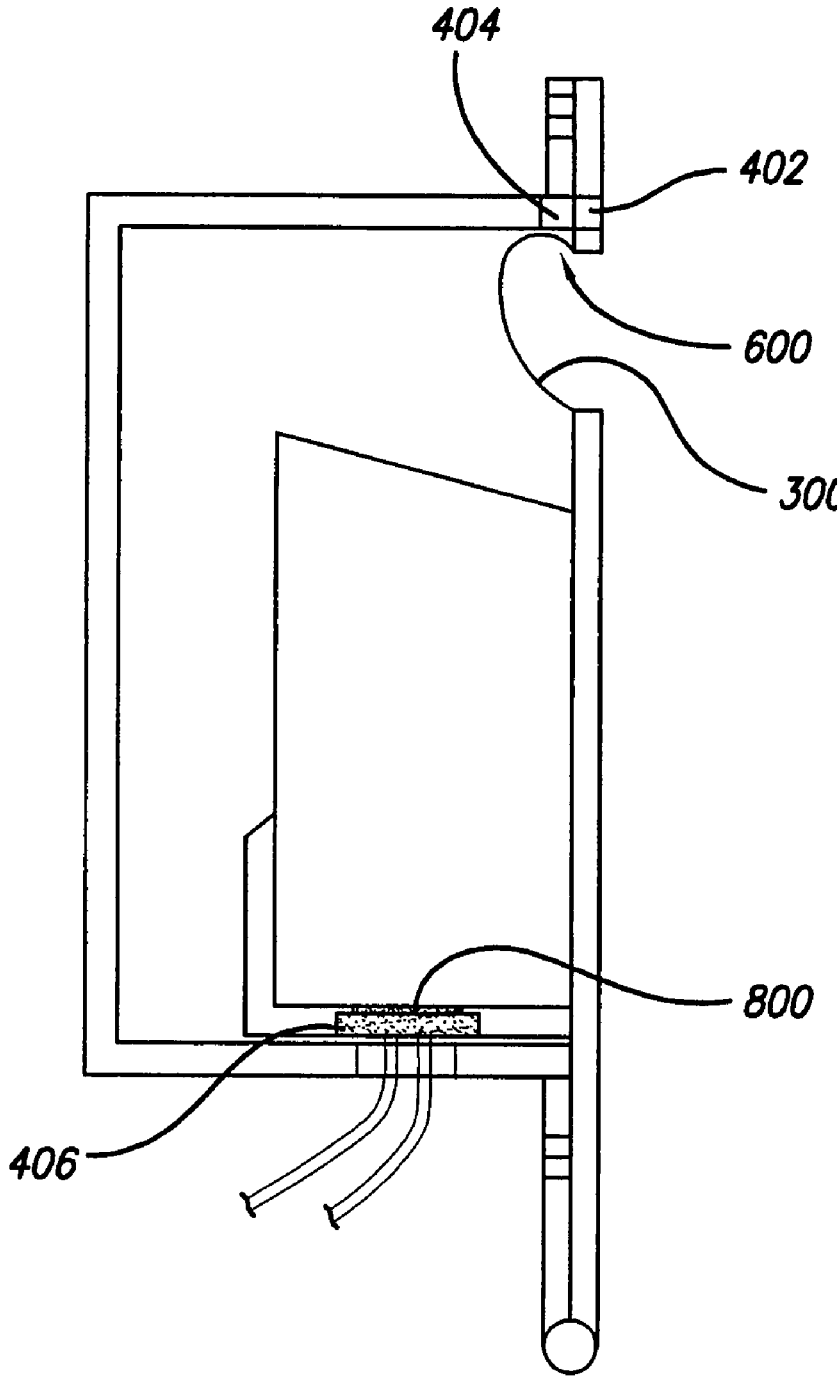
FIG. 6 is a side view of an embodiment of the current invention.
Figure 7:
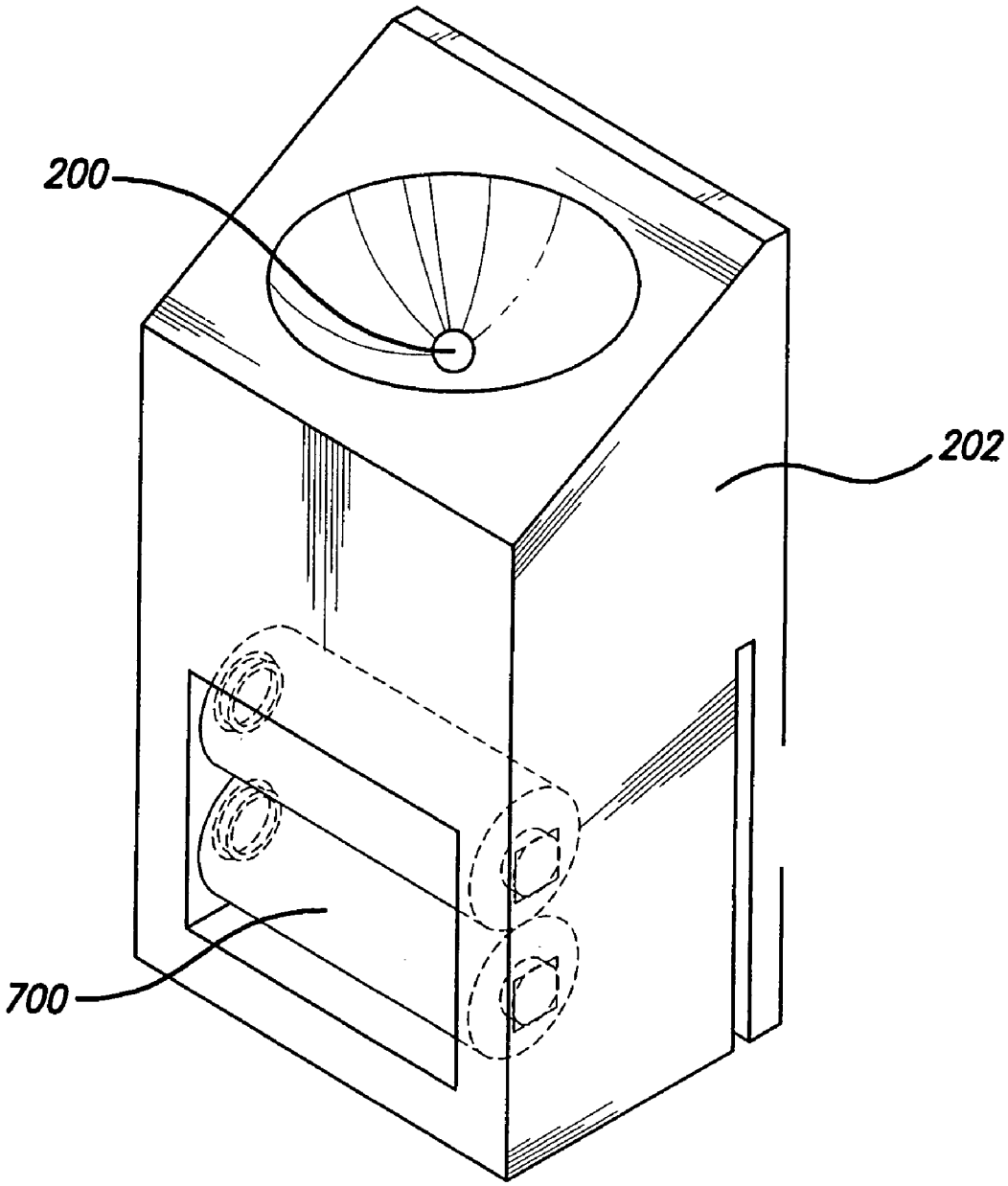
FIG. 7 is a perspective view of the light source of the current invention.
Figure 8:
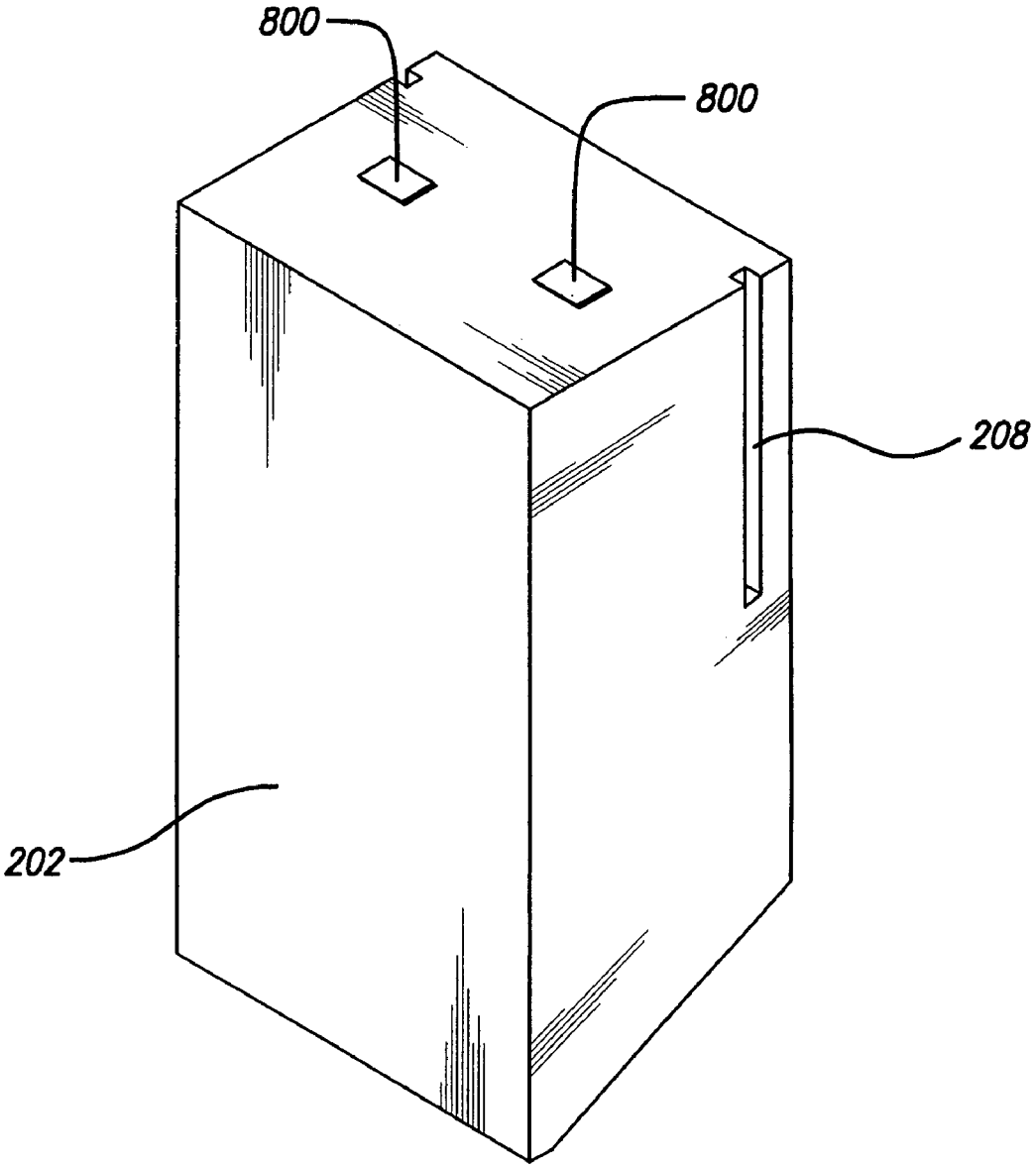
FIG. 8 is a perspective view of the bottom of the light source of the current invention.

As shown in FIGS. 4A and 5A, the battery recharging base 406 can be incorporated into the floor 210 of the support 204. The battery recharging base 406 can be wired so as to draw its power from the mains power supply so that it can charge the power source 700 of the light source 202 when mains power is available. In addition, the light source 202 can have a charging terminal 800 corresponding to the battery recharging base 406 so as to recharge the power source 700.

The emergency lighting system 102 can be wired such under normal conditions, for example, when power is available, the light source 202 remains off but in response to emergency situations, such as when power is interrupted the emergency lighting system 102 is deployed, as in FIG. 4A, and the light source 202 automatically turns on and draw its power from the power source 700. When power is restored, whether temporarily or permanently, the light source 202 automatically turns off and the power source 700 can automatically begin recharging again, even without closing the cover 106. Thus, if a subsequent emergency condition arises the power source 700 will have received charge during the interim normal condition. This will assure that the power source 700 will have maximum charge at all times.

In another embodiment, as shown in FIGS. 4B and 5B, the battery recharging base 406 can be incorporated into the housing 104 itself. The support 204 can have a hole on the floor 210 so that the battery recharging base 406 can make contact with the charging terminal 800 of the light source 202. In another embodiment, the floor 210 can serve as a conduit between the battery recharging base 406 and the charging terminal 800.

The power source 700 can be a battery. In a preferred embodiment the battery is a rechargeable battery, such that when mains power is available the battery is charged by the available power supply but during a power failure the battery supplies power to the light source 202. When the power is restored the battery can be re-charged. If a situation arises that interrupts the power to the building temporarily the emergency lighting system 102 would deploy. If the power is restored the lights would turn off and the power source 700 would resume charging so as to be able to supply power if the lights were to be interrupted again. Otherwise, the light source 202 would remain on and the battery power would be exhausted and not be available the next time the power is interrupted.

In another embodiment, the light source 202 or the power source 700 can further comprise a battery life indicator 304 to provide information regarding the amount of power remaining in the battery. The cover 106 of the housing 104 would further comprise a second transparent portion 108 through which the battery life indicator 304 could be perceived. The second transparent portion 108 can be a hole, a window, a plastic, or any other material that allows transmission of light. The second transparent portion 108 can also be a variety of different colors. Alternatively, or concomitantly, the audible alarm 302 can also serve to indicate when a battery requires replacing. The cover 106 can have a perforation 110 so as to provide a means of transmitting the audible signal.

The emergency light can be retrofitted into an existing outlet by removing the existing outlet and replacing it with the emergency lighting system 102. Alternatively, a new single gang "old work" box could be installed next to an existing outlet and mains power could be taken from the existing outlet to charge the power source 700 and electromagnet 404. This would prevent the occupant from losing the use of an outlet.

The preferred normal and emergency conditions where this device would be applicable are when power is available and during power outages. The emergency lighting system can be wired such that when power is available to a building or a home, the emergency lighting system 102 would be off and the power source 700 would be charged by the available power. During the power outage, the emergency lighting system 102 would deploy and the light source 202, powered by the power source 700, would automatically turn on and depending on the embodiment, the cover 106 would open and the light source 202 would be presented for removal if necessary. When the power is restored, the light source 202 would automatically turn off and the power source 700 would begin charging again.

The emergency lighting system could further comprise a contact closure/relay type input on it in order for the lights to be controlled by an outside Home Automation system or lighting control system, such as a fire or burglar alarm system. This could be tied to all sorts of logic based situations. For example, this connection could provide a trigger to notify a home automation system that the lights have been deployed. The home automation system could then activate pre-programmed macros or sequences based on that condition. Some examples of these macros could be to shut down computer equipment, turn on back-up power to the building or any other safety related sequence. Utilizing the trigger connection, the lights could also notify a security or fire alarm system that the emergency lights have been deployed so that those systems could, in turn, notify the authorities or any outside agency or company that should know that there was a power loss. This connection could also be used to provide an accurate record of when the lights were deployed, which could be valuable information to an outside agency, such as the police or fire department.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. An emergency lighting system comprising:

a. a housing;

b. a removable light source engaged inside the housing during a normal condition, wherein the removable light source is not connected to the housing by electrical wires, the removable light source comprising:

i) at least one power source, ii) wherein the light source remains off under the normal condition and the light source automatically turns on in response to an emergency condition and wherein the removable light source can be used away from the housing; and c. a cover attached to the housing, wherein the cover comprises a means for quickly and easily detaching the cover from the housing so as to provide access to the light source during the emergency condition, and a means for slidably engaging the removable light source onto the cover for quick and easy removal from the cover.

2. The emergency lighting system of claim 1, wherein the cover is flat so as to inconspicuously blend in with a wall, and wherein the cover further comprises a support comprising a tongue, and the light source further comprises a groove to slidably engage with the tongue of the support for quick and easy removal and replacement of the light source from the cover.

3. The emergency lighting system of claim 2, wherein the power source is a battery wherein the battery is a rechargeable battery, such that when a power is available the rechargeable battery is charged by an available power supply but during a power failure the rechargeable battery supplies power to the light source and when the power is restored the rechargeable battery is re-charged.

4. The emergency lighting system of claim 3, wherein the light source further comprises a wide angle LED light bulb.

5. The emergency lighting system of claim 4, wherein the cover comprises a means for transmitting a light during the emergency condition.

6. The emergency lighting system of claim 2, wherein the power source is a battery and wherein the light source further comprises a battery life indicator to provide information regarding the battery life.

7. An emergency lighting system comprising:

a. a housing;

b. a removable light source engaged inside the housing during a normal condition, wherein the removable light source is not connected to the housing by electrical wires, the removable light source comprising:

i) at least one power source, and ii) a groove, wherein the light source remains off under a normal condition and the light source automatically turns on in an emergency condition and wherein the light source is removable from the housing and can be used away from the housing; and c. a cover attached to the housing, the cover comprising a support for the removable light source, the support comprising a tongue to slidably engage the groove of the removable light source, wherein the cover opens automatically during a power failure to provide a means for accessing the light source.

8. The emergency lighting system of claim 7, wherein the cover is flat so as to inconspicuously blend in with a wall.

9. The emergency lighting system of claim 7, wherein the power source is a battery wherein the battery is a rechargeable battery, such that when a power is available the battery is charged by a mains power supply but during a power failure the rechargeable battery supplies power to the light source and when the mains power restored the battery is re-charged.

10. The emergency lighting system of claim 7, wherein the power source is a battery and wherein the light source further comprises a battery life indicator to provide information regarding the battery life.

11. The emergency lighting system of claim 7, wherein the light source further comprises a wide angle LED light bulb.

12. An emergency lighting system comprising:

a. a housing;

b. a removable light source engaged inside the housing during a normal condition, wherein the removable light source is not connected to the housing by electrical wires, the light source comprising:

i) at least one power source, and ii) a groove, wherein the light source remains off under a normal condition and the light source automatically turns on in an emergency condition; and c. a cover attached to the housing, the cover comprising a support for the removable light source, the support comprising a tongue to slidably engage the groove of the removable light source wherein the cover can be quickly and easily opened manually during a power failure to provide a means for accessing the light source and wherein the cover is flat so as to inconspicuously blend in with a wall.

13. The emergency lighting system of claim 12, wherein the light source is removable from the housing and can be used apart from the housing.

14. The emergency lighting system of claim 12, wherein the cover further comprises a transparent portion, such that a light transmission can be detected during a power failure.

15. The emergency lighting system of claim 12, wherein the cover further comprises a handle.

16. The emergency lighting system of claim 12, wherein the power source is a battery wherein the battery is a rechargeable battery, such that when a power is available the battery is charged by the available power supply but during a power failure the battery supplies power to the light source and when the power restored the battery is re-charged.

17. The emergency lighting system of claim 12, wherein the light source further comprises a wide angle LED light bulb.

* * * * *